United States Patent [19]

Willott

[11] Patent Number: 4,542,738

[45] Date of Patent: Sep. 24, 1985

[54] APPLIANCE

[76] Inventor: Lionel R. Willott, 15 Farrell Dr., Tugun Qld. 4224, Australia

[21] Appl. No.: 491,029

[22] Filed: May 3, 1983

[30] Foreign Application Priority Data

Jun. 17, 1982 [AU] Australia ..... PF4475

[51] Int. Cl.[4] ..... A61H 7/00

[52] U.S. Cl. ..... 128/67; 128/57

[58] Field of Search ..... 128/24.4, 57, 59, 60, 128/61, 67, 68, 69, 329 A; 272/138, 136, 144; 5/181, 186, 200 R, 202, 285, 286

[56] References Cited

U.S. PATENT DOCUMENTS

| | | | |
|---|---|---|---|
| 1,265,083 | 5/1918 | Hoard | 128/57 |
| 1,501,341 | 7/1924 | Hoard | 128/57 |
| 1,537,464 | 5/1925 | Hummel, Jr. | 128/57 |
| 1,929,107 | 10/1933 | Weaver | 128/32 X |
| 2,180,775 | 11/1939 | Stevens | 128/69 |
| 2,230,057 | 1/1941 | Hill | 128/57 |

*Primary Examiner*—Richard J. Apley
*Assistant Examiner*—Daivd J. Brown
*Attorney, Agent, or Firm*—Lackenbach, Siegel, Marzullo, Presta & Aronson

[57] ABSTRACT

A massage appliance embodying a support frame adapted to be located adjacent the back of a user for supporting the user in a prone position and having pressure applying means mounted for movement relative to the support frame along the spine of the user. The appliance comprises a pair of spaced apart side rails between which the back of the user is positioned. A carriage is disposed on each of the side rails, and a pressure applying assembly is carried by and between the carriages and supports the pressure applying means. Handles arranged adjacent the rails are connected to the carriages and each handle has a plurality of spaced locating notches each engageable with a respective locating means fixed to the rails to selectively position the pressure applying means in an indexed step wise movement or manner relative to the frame.

9 Claims, 3 Drawing Figures

APPLIANCE

This invention relates to an appliance which may be used to relieve spinal and other body discomforts and to a method of treatment of spinal disorders.

BACKGROUND OF THE INVENTION

Many body disorders including nervous disorders stem from spinal problems including misalignment of the spine. Such misalignment can be due to incorrect exercising or use of the back or perhaps due to an accident. Acupressure is used as a therapy for the treatment of bad backs and devices such as that described in U.S. Pat. No. 4,233,966 have been proposed to enable self treatment for back disorders. This device utilizes knobs or balls arranged in a selected array on a fixed supporting base to provide means for applying pressure simultaneously to selected positions of the anatomy. Such devices do not provide for the location of the pressure applying means with respect to the patient and accordingly they are difficult to use and thus often ineffective.

The present invention has been devised to alleviate the disadvantages associated with such prior art devices and to provide an appliance for and a method of treating the back, particularly in the area of the spine, in order to relieve discomfort caused by back problems. Other objects and advantages of this invention will hereinafter become apparent.

SUMMARY OF THE INVENTION

With the foregoing and other objects in view, this invention in one aspect resides broadly in an appliance including a supporting frame adapted to be located adjacent the back of a user and pressure applying means supported by and movable relative to said supporting frame in a longitudinal direction along the spine of the user.

Suitably the supporting frame is adapted to be supported in a substantially horizontal attitude on a surface whereby it may be disposed beneath a person in a reclined attitude and suitably the pressure applying means includes a pair of laterally spaced ball-like members which may be resilient or of rigid form and located centrally beneath the back of a person in the reclining position. Preferably the ball-like members are supported in transversely spaced relationship on an axle which may be moved by the user in a longitudinal direction such as for example, to be positioned adjacent the users neck or thighs or in positions intermediate therebetween. The pressure applying means may be arranged for stepwise movement along the spine in order to pressurize the back at locations adjacent opposite sides of successive vertebra. Alternatively elongate pressure applying means extending along several vertebra may be used and the advancement along the spine may be controlled or at random.

In one form notched elongate handles are used to index the movement of the pressure applying means but this could be controlled by gear means or otherwise as desired.

In a further aspect, this invention resides in a method of treating spinal disorders including the steps of providing an appliance as defined above; reclining on said appliance so that the pressure applying means is guided for movement along the users spine and advancing said pressure applying means along the spine.

BRIEF DESCRIPTION OF THE DRAWINGS

In order that the invention may be more readily understood and put into practical effect, reference will now be made to the accompanying drawings which illustrate a preferred embodiment of the invention, wherein.

DESCRIPTION OF THE PREFERRED EMBODIMENT

Figure 1:
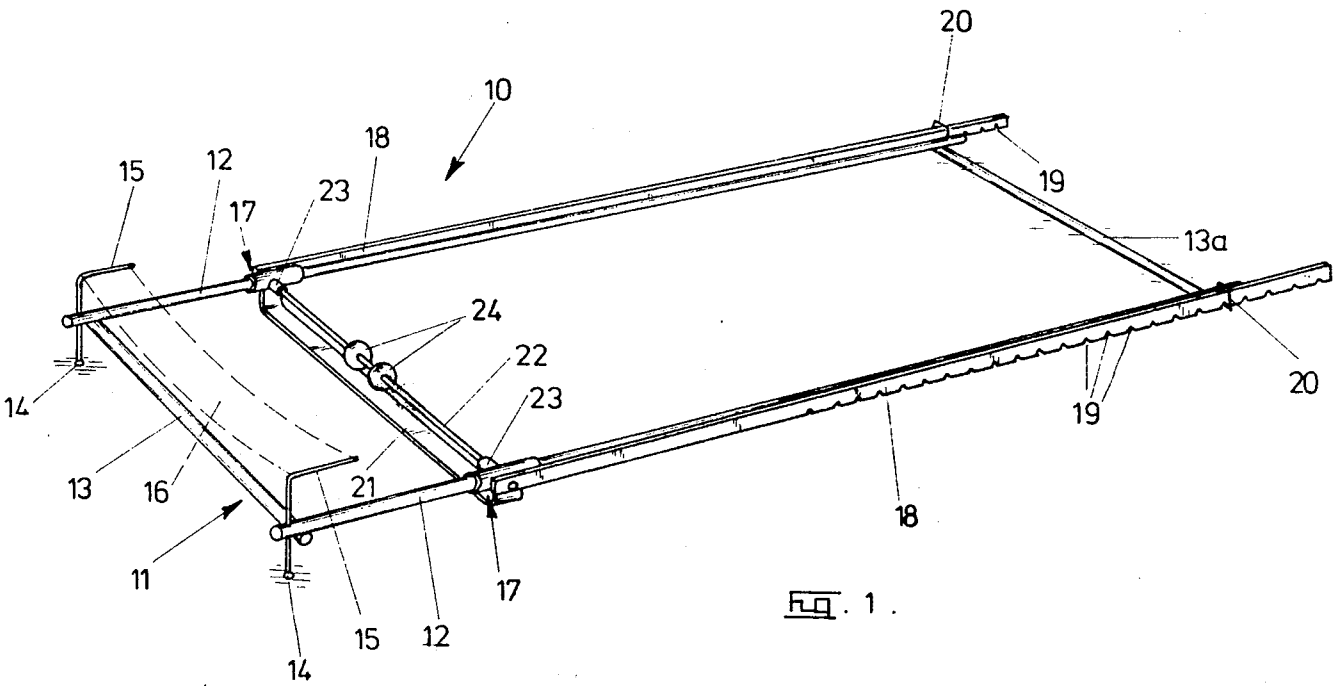
FIG. 1 is a perspective view of a preferred form of appliance made in accordance with the present invention.
Figure 2:
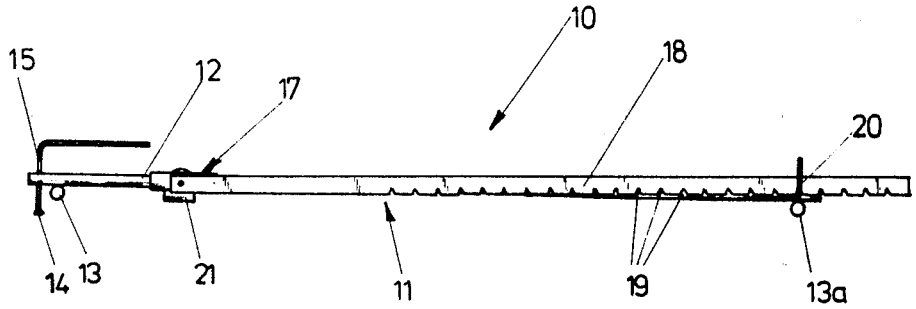
FIG. 2 is a side view of the appliance.
Figure 3:
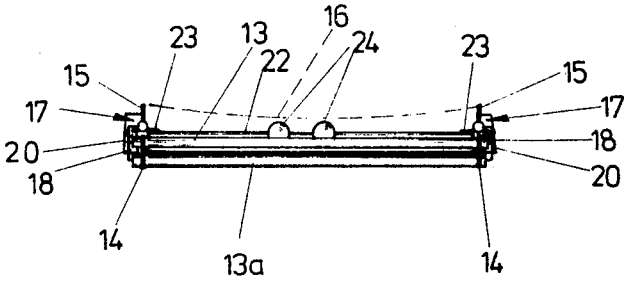
FIG. 3 is an end view of the appliance.

In the illustrated embodiment the appliance 10 includes a rectangular support frame assembly 11 consisting of a pair of spaced parallel side rails 12 interconnected by transverse members 13 and 13*a* which extend beneath the side rails 12. The end member 13*a* supports one end of the frame assembly while the other end is supported by the legs 14 whereby the rails in use incline downwardly towards the member 13*a*. The legs extend upwardly at 16 beyond the rails 12 to support a sling-like member 16 extending transversely across between the side members 15 to form a headrest as illustrated. Of course any other suitable headrest means may be used as desired. The headrest could be a separate component but preferably it is integral with the device so that in use the user's head assists in locating the appliance relative to the user.

An adjustable carriage assembly 17 is supported on each side rail 12. Each carriage assembly 17 is freely slidable along the respective rails 12 between the opposite ends thereof and elongate handles 18 are fixed pivotably thereto and extend in spaced relationship to the side rails 12. The handles 18 are each provided with a plurality of equally spaced locating notches 19 engagable with a respective locating bar 20 fixed to the side rails 12 so that they may be lifted and moved to engage a selected notch about the respective bar 20 to thereby secure the carriages 17 in a selected position relative to the headrest 16. The handles 18 are so positioned that they may be grasped at a position remote from carriage assemblies 17 by a user reclined between the rails 12 to move the carriage assemblies 17 along the rails 12.

The carriage assemblies 17 are rigidly interconnected by a lower transversely extending bar 21 and an axle 22 is supported rotatably at each end in the sockets 23 fixed to the respective carriage assemblies 17 whereby the axle 22 may rotate freely about its axis which extends between the side rails 12. A pair of golf ball like resilient members 24 are supported on the axle 22 in spaced relationship and symmetrically at the central portion of the axle 22 and these may rotate freely with the axle 22.

If desired the spacing of the balls may be selectively variable or it may be fixed at a distance less than or substantially equal to the diameter of the resilient balls 24.

In use, the appliance 10 is placed on a support surface and the user lies reclined with his or her head supported on the headrest 16 and with the side rails 12 extending along either side of the user's body. The handle members 18 may be grasped by the user and manipulated to move the ball like members 24 supported on the rotatable axle 23 longitudinally along the user's back. The ball like members 24 in use are positioned at each side of the user's spine so that the weight of the user is supported by the head, the buttocks and lower part of the body and by the ball like members 24. The latter are suitably located at selected areas along the spine for a selected period which may vary from seconds to minutes. The balls 24 apply pressure at correspondingly opposite positions about the spine. The ball like members 24 may be advanced stepwise along the spine or they may be advanced to any position as will be readily apparent to the user for relief of discomfort. Alternatively they may be reciprocated back and forth along the body if desired.

OPERATION OF THE APPARATUS

Preferably the device is used as follows:

(a) position the pressure applying means under the headrest and recline with the head on the headrest 16 and the body between the rails 12;

(b) take the handles 18 one in each hand and move them towards the user's feet until the balls 24 come into contact with the top of the spine;

(c) relax in this position a while, then arching the back, head on headrest, move the balls 24 to the next position, one notch on the handles 18 and repeat this step as desired.

If the pressure at any stage is severe, relax the muscles for more comfort. There are approximately twenty pressure positions as the balls move down the spine.

The ball like members 24 in use provide a steady bearing pressure to the areas adjacent each side of the spine and of course, as they are moved along the spine they rotate freely for easy movement along the user's back. The amount of pressure applied to the body adjacent the spine is determined by the height of the operative upper surface of the balls above the supporting surface and of course this pressure should not be excessive. It has been found in use that if the ball like members 24 have the physical characteristics and size of golf balls, then location of the ball like members 24 approximately twelve millimeters above the support surface 14 gives a suitable result. Furthermore an apron of padded material may be secured permanently or releasably to the headrest, which is preferably padded for user comfort, and arranged to extend beneath the user's back and above the members 24. This apron may be provided with ties to secure it to the frame assembly 11 so that it remains in place during use of the appliance 10.

Of course, the resilience of the ball like members and the size of the ball like members can be varied to suit particular appliances. If desired the height of the supporting legs may be adjustable or of course pillows or the like may be placed beneath a user for elevation relative to the appliance. Also several pairs of ball like members 24 may be supported on the carriages 17 if desired. Additionally the pressure applying means may be non-rotatably mounted on the support frame and they may be shaped other than spherical. For example they could be conically shaped if desired.

When the ball like members 24 have been moved to a desired location the handle members 18 may be engaged with the locking means 22 to hold them in their selected location relative to the body of the user. In use it is believed that the above device will be useful for treating back disorders particularly those related to the spine and associated muscles. It is further believed that the device will provide a beneficial effect on the nervous system and thus will relieve acute pain in the back and other parts of the body of the user. Also a user may obtain beneficial exercise by securing one handle 18 with one foot and running the other foot over the ball like pressure applying means. The device can also be used to massage shoulders and the upper neck.

It will of course be realized that the above has been given only by way of illustrated example of the invention and all such modifications and variations thereto as would be apparent to persons skilled in the art are deemed to fall within the broad scope and ambit of the present invention as is defined in the appended claims.

I claim:

1. A massage appliance having a support frame adapted to be located adjacent the back of a user for supporting the user in a prone position and having pressure applying means mounted for movement relative to the support frame along the spine of the user and further comprising:

a pair of spaced apart side rails between which the back of the user is adapted to be positioned, a carriage on each said side rail, a pressure applying assembly carried by and disposed between said carriages for supporting said pressure applying means, and a pair of handles each connected to a respective said carriage and arranged adjacent said rails, each said handle having a plurality of spaced locating notches each engageable with a respective locating means fixed to said rails to selectively position said pressure applying means in a step wise manner relative to said frame.

2. The massage appliance according to claim 1, wherein said pressure applying means includes a pair of pressure applying members supported in transversely spaced apart relationship.

3. The massage appliance according to claim 1, wherein said pressure applying means are substantially spherical and are rotatably supported about transverse axes.

4. The massage appliance according to claim 1, wherein said pressure applying means are formed of resilient material.

5. The massage appliance according to claim 1, wherein said locating notches are spaced a distance from each other corresponding to the spacing between one's vertabra.

6. The massage appliance according to claim 1, wherein said spherical pressure applying means are a plurality of ball-like members spaced from each other a distance no greater than the diameter of said ball-like members.

7. The massage appliance according to claim 6, wherein said ball-like members comprise two "golf" ball sized resilient members spaced submetrically at the central portion of an axle about which said members are rotatably disposed.

8. The massage appliance according to claim 1, wherein said handles are elongated and disposed in spaced relationship to said rails.

9. An appliance according to claim 1, wherein there is provided a headrest assembly at one end of said supporting frame and said handles extend from said carriages towards the other end of said frame.

* * * * *